US008653374B2

(12) United States Patent
Kusakari et al.

(10) Patent No.: US 8,653,374 B2
(45) Date of Patent: Feb. 18, 2014

(54) ALUMINUM ALLOY WIRE

(75) Inventors: Misato Kusakari, Osaka (JP); Yoshihiro Nakai, Osaka (JP); Taichirou Nishikawa, Osaka (JP); Yoshiyuki Takaki, Osaka (JP); Yasuyuki Ootsuka, Yokkaichi (JP)

(73) Assignees: Sumitomo Electric Industries, Ltd., Osaka (JP); Autonetworks Technologies, Ltd., Yokkaichi-shi (JP); Sumitomo Wiring Systems, Ltd., Yokkaichi-shi (JP)

( * ) Notice: Subject to any disclaimer, the term of this patent is extended or adjusted under 35 U.S.C. 154(b) by 431 days.

(21) Appl. No.: 13/058,421

(22) PCT Filed: Jun. 12, 2009

(86) PCT No.: PCT/JP2009/002686

§ 371 (c)(1),
(2), (4) Date: Feb. 10, 2011

(87) PCT Pub. No.: WO2010/018647

PCT Pub. Date: Feb. 18, 2010

(65) Prior Publication Data

US 2011/0132659 A1 Jun. 9, 2011

(30) Foreign Application Priority Data

Aug. 11, 2008 (JP) ..... 2008-206727

(51) Int. Cl.
*H01B 5/00* (2006.01)

(52) U.S. Cl.
USPC ..... 174/126.1

(58) Field of Classification Search
USPC ..... 174/23 R, 102 R, 108, 109, 23 C, 27, 174/128 R, 107, 126.2, 125.1
See application file for complete search history.

(56) References Cited

U.S. PATENT DOCUMENTS

| | | | | |
|---|---|---|---|---|
| 3,586,751 | A * | 6/1971 | Schoerner | 174/115 |
| 3,811,846 | A * | 5/1974 | Schoerner et al. | 420/535 |
| 3,826,690 | A * | 7/1974 | Bleinberger et al. | 148/526 |
| 3,952,571 | A * | 4/1976 | Yokota et al. | 72/286 |

(Continued)

FOREIGN PATENT DOCUMENTS

| | | |
|---|---|---|
| JP | 170213 | 5/1947 |
| JP | 60-215751 | 10/1985 |

(Continued)

*Primary Examiner* — William H Mayo, III
(74) *Attorney, Agent, or Firm* — McDermott Will & Emery LLP

(57) ABSTRACT

An aluminum alloy wire, an aluminum alloy stranded wire, a covered electric wire, and a wire harness that are of high toughness and high electrical conductivity, and a method of manufacturing an aluminum alloy wire. The aluminum alloy wire contains not less than 0.2% and not more than 1.0% by mass of Mg, not less than 0.1% and not more than 1.0% by mass of Si, not less than 0.1% and not more than 0.5% by mass of Cu, and a remainder including Al and an impurity, and satisfies 0.8 Mg/Si≤2.7 by mass ratio. The Al alloy wire is manufactured through the successive steps of casting, rolling, wiredrawing, and softening treatment.

14 Claims, 2 Drawing Sheets

(56) References Cited

U.S. PATENT DOCUMENTS

| | | | | | |
|---|---|---|---|---|---|
| 3,984,619 | A | * | 10/1976 | Raw et al. | 174/23 R |
| 4,183,771 | A | * | 1/1980 | Setzer et al. | 148/550 |
| 4,574,604 | A | * | 3/1986 | Vogel et al. | 72/38 |
| 4,604,860 | A | * | 8/1986 | Matsuura et al. | 57/9 |
| 5,110,545 | A | * | 5/1992 | McAuliffe et al. | 420/534 |
| 2002/0162607 | A1 | * | 11/2002 | Chadwick et al. | 148/415 |
| 2008/0196923 | A1 | * | 8/2008 | Susai et al. | 174/110 R |

FOREIGN PATENT DOCUMENTS

| | | | | |
|---|---|---|---|---|
| JP | 63-157843 | | 6/1988 | |
| JP | 2000-207940 | | 7/2000 | |
| JP | 2000-212664 | | 8/2000 | |
| JP | 2004-134212 | * | 4/2004 | H01B 1/02 |
| JP | 2005-174554 | | 6/2005 | |
| JP | 2006-253109 | | 9/2006 | |
| JP | 2008-112620 | * | 5/2008 | H01B 5/08 |

* cited by examiner

ALUMINUM ALLOY WIRE

RELATED APPLICATIONS

This application is the U.S. National Phase under 35 U.S.C. §371 of International Application No. PCT/JP2009/002686, filed on Jun. 12, 2009, which in turn claims the benefit of Japanese Application No. 2008-206727, filed on Aug. 11, 2008, the disclosures of which Applications are incorporated by reference herein.

TECHNICAL FIELD

The present invention relates to an aluminum alloy wire and an aluminum alloy stranded wire used as a conductor of an electric wire, a covered electric wire having the alloy wire or the alloy stranded wire as a conductor, a wire harness including the covered electric wire, a method of manufacturing the alloy wire, and an aluminum alloy. In particular, the present invention relates to an aluminum alloy wire having well-balanced characteristics (strength, toughness, electrical conductivity) suitable for a conductor for an electric wire of a wire harness that is used for a transportation device such as motor vehicle.

BACKGROUND ART

Conventionally, for wiring structures of transportation devices such as motor vehicle and airplane and of industrial devices such as robot, a structure in the form called wire harness including a plurality of bound electric wires with terminals has been used. Conventionally, the material to constitute a conductor for an electric wire of the wire harness is mostly copper having an excellent electrical conductivity or a copper-based material such as copper alloy.

With the recent rapid enhancement in performance and capabilities of the motor vehicle and with the increase of a variety of electrical devices, control devices and the like that are mounted on the vehicle, electric wires used for these devices also tend to increase. Meanwhile, recently for the sake of environmental conservation, improved fuel economy of motor vehicles and airplanes for example has been desired. A reduced weight can improve the fuel economy. In view of this, for the purpose of reduction in weight of electric wires, studies are conducted on use, as a conductor, of aluminum having its specific gravity which is about one-third that of copper. For instance, there has been an example where pure aluminum is used for a conductor for an electric wire of 10 $mm^2$ or more such as a battery cable of a motor vehicle. Pure aluminum, however, has a lower strength and a lower fatigue resistance than a copper-based material, and therefore, pure aluminum is difficult to be applied to common conductors for electric wires such as those having a conductor's cross-sectional area of 1.5 $mm^2$ or less. In contrast, Patent Document 1 discloses an electric wire for a wire harness of a motor vehicle that is made of an aluminum alloy having a higher strength than pure aluminum.

PRIOR ART DOCUMENTS

Patent Documents

Patent Document 1: Japanese Patent Laying-Open No. 2004-134212

SUMMARY OF THE INVENTION

Problems to be Solved by the Invention

The conventional aluminum alloy electric wire, however, does not adequately have required characteristics for a wire harness disposed in a transportation device such as motor vehicle.

A higher electrical conductivity is desired for a conductor for an electric wire. The aluminum alloy electric wire disclosed in Patent Document 1, however, does not have a sufficiently high electrical conductivity.

Further, an aluminum alloy electric wire with a high strength like the one disclosed in Patent Document 1 has an insufficient toughness. Conventionally, studies have been conducted on an aluminum alloy to constitute a conductor for an electric wire of a wire harness in a motor vehicle, mainly with the purpose of improving the strength, and the studies are insufficient in terms of the toughness (such as impact resistance and elongation). The inventors of the present invention have conducted studies to make a finding that, when a wire harness for which a high-strength aluminum alloy electric wire as disclosed in Patent Document 1 is used is installed in a device or the like, the conductor could be ruptured in the vicinity of the boundary between the conductor and a terminal portion. In other words, while studies have been conducted conventionally on the characteristics of the wire itself, the studies have not been conducted on the characteristics when the wire is applied to a wire harness including a terminal portion. A wire harness having a sufficient toughness required at the time of being installed has not been developed.

The terminal portion is attached in such a manner that enables a desired electrically conductive state to be maintained. A finding, however, has been made as follows. In the conventional aluminum alloy electric wire, the stress at the time of the attachment is relaxed (stress decreases with time), which results in decrease in securing strength between the electric wire and the terminal portion and could result in dropping off of the terminal portion from the electric wire. Namely, regarding the electric wire for which the conventional aluminum alloy wire is used, the attached terminal portion could loosen. It is therefore desired to develop a wire harness in which the securing strength between an electric wire and a terminal portion is high.

In view of the foregoing, an object of the present invention is to provide an aluminum alloy wire and an aluminum alloy stranded wire having a high strength, a high toughness, and a high electrical conductivity and suitable for a conductor for an electric wire of a wire harness, as well as a covered electric wire suitable for a wire harness. Another object of the present invention is to provide a wire harness including an electric wire with a high strength, a high toughness, and a high electrical conductivity. Still another object of the present invention is to provide a method of manufacturing the above-described aluminum alloy wire of the present invention.

Means for Solving the Problems

Having studied an aluminum alloy wire of a high electrical conductivity that sufficiently has characteristics desired for a wire harness, particularly such as impact resistance and securing strength between the wire and a terminal portion, and is suitable for a conductor for an electric wire, the inventors of the present invention have made a finding that it is preferable to use a softened material having undergone a softening treatment after (which may not necessarily be immediately after) being wiredrawn. The softening treatment can improve not only the elongation of the wire but also the electrical conductivity by removing strain resulting from plastic working such as wiredrawing. The inventors have also made a finding that an aluminum alloy wire that can be improved in impact resistance and securing strength between the wire and a terminal portion and is also excellent in strength can be obtained by performing the softening treatment and additionally defining an aluminum alloy as having a specific composition. The present invention has been made based on these findings as described above.

A method of manufacturing an aluminum alloy wire of the present invention includes the following steps.

1. The step of forming a cast material by casting a molten aluminum alloy containing not less than 0.2% and not more than 1.0% by mass of Mg, not less than 0.1% and not more than 1.0% by mass of Si, not less than 0.1% and not more than 0.5% by mass of Cu where Mg and Si having a mass ratio Mg/Si satisfying 0.8≤Mg/Si≤2.7, and a remainder including Al.

2. The step of forming a rolled material by performing rolling on the cast material.

3. The step of forming a wiredrawn material by performing wiredrawing on the rolled material.

4. The step of forming a softened material by performing softening treatment on the wiredrawn material.

The manufacturing method of the present invention performs the softening treatment on the wiredrawn material so that the wire after being softening-treated has an elongation of not less than 10%. The aluminum alloy wire thus obtained is used as a conductor.

The above-described manufacturing method provides the aluminum alloy wire of the present invention. The aluminum alloy wire of the present invention is used as a conductor, and contains not less than 0.2% and not more than 1.0% by mass of Mg, not less than 0.1% and not more than 1.0% by mass of Si, not less than 0.1% and not more than 0.5% by mass of Cu, and a remainder including Al and an impurity. The above-described Mg and Si have a mass ratio Mg/Si satisfying 0.8≤Mg/Si≤2.7. This aluminum alloy wire (hereinafter referred to as Al alloy wire) has an electrical conductivity of not less than 58% IACS and an elongation of not less than 10%.

Since the Al alloy wire of the present invention is a softened material having undergone softening treatment, the wire is excellent in both of the electrical conductivity and the toughness, and has a high connection strength with a terminal portion. Further, since the Al alloy wire of the present invention has a specific composition, it also has a high strength. Therefore, the Al alloy wire of the present invention adequately has the electrical conductivity, the impact resistance, the strength, and the connectivity with a terminal portion that are desired for a wire harness, and can suitably be used as a conductor for an electric wire of a wire harness. In the following, the present invention will be described in more detail. Here, the content of an element is expressed in mass %.

[Al Alloy Wire]

<<Composition>>

An Al alloy of the present invention to constitute an Al alloy wire of the present invention is an Al—Mg—Si—Cu-based alloy containing 0.2 to 1.0% of Mg, 0.1 to 1.0% of Si, and 0.1 to 0.5% of Cu. 0.2% or more of Mg, 0.1% or more of Si, and 0.1% or more of Cu as contained can provide the Al alloy wire that is excellent in strength and excellent in stress relaxation resistance. Namely, the degree of lessening of the securing strength between the terminal portion and the electric wire, resultant from stress-relaxation-induced reduction of the stress generated when the terminal portion is attached, can be reduced. While higher contents of Mg, Si, and Cu increase the strength of the Al alloy, they also cause reduction in electrical conductivity and toughness and cause breakage of the wire to be likely to occur at the time of wiredrawing for example. In view of this, the content of Mg is defined as not more than 1.0%, the content of Si is defined as not more than 1.0%, and the content of Cu is defined as not more than 0.5%. Specifically, while Mg causes a large reduction of the electrical conductivity, Mg is highly effective in improving the strength. In particular, Si of a content in a specific range can be used simultaneously with Mg to effectively improve the strength by age hardening. Cu causes a less reduction in electrical conductivity and can improve the strength. More preferably, the content of Mg is not less than 0.3% and not more than 0.9%, the content of Si is not less than 0.1% and not more than 0.8%, and the content of Cu is not less than 0.1% and not more than 0.4%. Further, Mg and Si have a mass ratio Mg/Si satisfying 0.8 Mg/Si 2.7. Mg/Si of less than 0.8 does not provide the effect of sufficiently improving the strength, and Mg/Si exceeding 2.7 causes a larger reduction in conductivity. More preferably, the ratio satisfies 0.9≤Mg/Si≤2.6.

Further, the above-described Al alloy containing at least one of Ti and B can further be improved in strength. Ti and B have the effect of refining the crystal structure of the Al alloy at the time of casting. The fine crystal structure can improve the strength. While it may be only B that is contained, containing of only Ti or particularly containing of both B and Ti enhances the effect of refining the crystal structure. In order to have a sufficient effect of refining the crystal structure, it is preferable that not less than 100 ppm and not more than 500 ppm (not less than 0.01% and not more than 0.05%) by mass ratio of Ti and not less than 10 ppm and not more than 50 ppm (not less than 0.001% and not more than 0.005%) by mass ratio of B are contained. A Ti content higher than 500 ppm and a B content higher than 50 ppm saturate the above-described refinement effect or cause the electrical conductivity to decrease.

<<Characteristics>>

The Al alloy wire of the present invention is formed of the Al alloy of the present invention having a specific composition and is a softened material, and therefore, the Al alloy wire is excellent in electrical conductivity and toughness and has an electrical conductivity of not less than 58% IACS and an elongation of not less than 10%. The Al alloy wire of the present invention can also satisfy an electrical conductivity of not less than 59% IACS and an elongation of not less than 20%, which however may be influenced by the type and the quantity of additive element(s) and the softening condition.

Further, the Al alloy wire of the present invention preferably has a tensile strength of not less than 120 MPa and not more than 200 MPa. The inventors of the present invention have made a finding that a conductor for an electric wire that merely has a high strength and is inadequate in terms of the toughness is not suitable for a wire harness. Generally, improvement of the strength causes reduction of the toughness. The tensile strength satisfying the above-described range can provide a high toughness and a high strength at the same time.

Additive element(s) (type and content) and manufacturing conditions (such as softening condition) can be adjusted appropriately to produce an Al alloy wire having its electrical conductivity, elongation, and tensile strength that satisfy their respective specific ranges defined above. When additive element(s) is (are) reduced or the heating temperature for the softening treatment is raised and thereafter the rate at which the temperature is lowered is decreased, the electrical conductivity and the toughness tend to increase. When the additive element(s) is (are) increased or the heating temperature for the softening treatment is lowered, the strength tends to increase.

<<Shape>>

For the Al alloy wire of the present invention, the extent to which the wire is drawn (rate of decrease in cross section) can appropriately be adjusted to allow the wire to have any of various wire diameters (diameters). For example, when the Al alloy wire is used as a conductor for an electric wire of a motor vehicle's wire harness, the wire diameter is preferably not less than 0.2 mm and not more than 1.5 mm.

The Al alloy wire of the present invention can also have any of various cross-sectional shapes depending on the die shape used for wiredrawing. The cross-sectional shape is typically a circular shape. In addition, the cross-sectional shape may also be an elliptical shape, a polygonal shape such as rectangular shape and hexagonal shape, and the like. The cross-sectional shape is not limited to a particular one.

[Al Alloy Stranded Wire]

The above-described Al alloy wire of the present invention may be a stranded wire made up of a plurality of wires stranded together. Even if the wires are of a small diameter, they may be stranded together to constitute a wire (stranded wire) with a high strength. The number of wires to be stranded together is not limited to a particular one. Examples of the number of wires may be 7, 11, 19, and 37. Further, the Al alloy stranded wire of the present invention may be a compressed wire in which the wires are stranded together and thereafter compression-molded, so that the wire diameter is smaller than the stranded wire in which the wires are only stranded together.

[Covered Electric Wire]

The Al alloy wire of the present invention, the Al alloy stranded wire and the compressed wire of the present invention as described above can suitably be used as a conductor for an electric wire. Depending on the intended use, they may each be used as it is as a conductor, or as a covered electric wire including an insulating cover layer formed of an insulating material around the outer periphery of the conductor. The insulating material can be selected as appropriate. Examples of the insulating material may include polyvinyl chloride (PVC), non-halogen resin, a material excellent in flame resistance, and the like. The thickness of the insulating cover layer may be appropriately selected in consideration of a desired insulating strength, and is not particularly limited.

[Wire Harness]

The above-described covered electric wire can suitably be used for a wire harness. At this time, at an end of the covered electric wire, a terminal portion is attached so that the wire can be connected to an intended object such as device. The terminal portion may be in any of various forms such as male type, female type, crimp type, and weld type, and is not particularly limited. The above-described wire harness may also include a group of electric wires where a plurality of covered electric wires share a single terminal. Further, a plurality of covered electric wires included in this wire harness may be bound together by a binding tool or the like so that an excellent handling property is achieved. This wire harness can suitably be used in various fields in which lightweight is desired, particularly in a motor vehicle for which further reduced weight is desired for the purpose of improving fuel economy.

[Manufacturing Method]

<<Casting Step>>

In accordance with a manufacturing method of the present invention, a cast material made of an Al alloy having the specific composition as described above is formed first. Casting to be used may be any of continuous casting for which a movable mold or a frame-shaped fixed mold is used, and mold casting for which a box-shaped fixed mold is used (hereinafter referred to as billet casting). The continuous casting can rapidly solidify a molten metal and therefore provide a cast material having a fine crystal structure. Further, the rapid solidification can refine crystal precipitates, and accordingly provide the cast material in which the fine crystal precipitates are uniformly dispersed. Use of such a cast material as a base material facilitates manufacture of an Al alloy wire having a fine crystal structure, and can improve the strength by refinement of the crystal. While the rate of cooling may be selected as appropriate, the cooling rate is preferably 20° C./sec or more within a range of 600 to 700° C. that is a temperature range in which the solid and the liquid of the molten metal coexist. For example, a continuous casting machine having a water-cooled copper mold and/or a forced water-cooling mechanism and the like may be used to achieve the rapid solidification at the cooling rate as described above.

In the case where Ti and/or B are/is to be added, it may preferably be added immediately before a molten metal is poured into a mold, so that local setting of Ti for example can be suppressed to thereby manufacture a cast material in which Ti for example is uniformly mixed.

<<Rolling Step>>

Next, the above-described cast material undergoes (hot) rolling to form a rolled material. Particularly in the case where a billet cast material made of an Al alloy having the above-described specific composition is used, preferably the material after being cast and before being rolled may undergo solution treatment and aging treatment, so that precipitate such as $Mg_2Si$ may be generated to improve the strength by precipitation strengthening (age hardening). The aging treatment is preferably performed at a heating temperature of 100° C. or more. The above-described aging treatment may also be performed on a rolled material after being rolled and before being wiredrawn or a wire (wiredrawn material) during wiredrawing. The aging treatment may also be performed on a stranded wire in which wires are stranded together. The aging treatment may be performed on at least one of the cast material, the rolled material, and the wiredrawn material so that the effect of improving the strength by precipitation strengthening as described above may be obtained.

The above-described casting step and rolling step may be performed successively to facilitate hot rolling by using the heat accumulated in the cast material, achieve high energy efficiency, and provide excellent productivity of the cast and rolled material as compared with the batch-type casting method.

<<Wiredrawing Step>>

Next, the above-described rolled material or continuously cast and rolled material undergoes (cold) wiredrawing to form a wiredrawn material. The extent to which the material is wiredrawn may be selected as appropriate depending on a desired wire diameter. A desired number of wiredrawn materials thus obtained may be prepared and stranded together to form a stranded wire.

<<Softening Treatment (Final Heat Treatment) Step>>

Next, the above-described wiredrawn material or stranded wire undergoes softening treatment. The softening treatment is performed under the condition that allows the elongation of the wire (single wire or stranded wire) after being softening-treated to be 10% or more. The softening treatment may be performed after wiredrawing and after stranding to allow the final stranded wire's elongation to be 10% or more. The softening treatment is performed to soften the wire and improve the toughness of the wire without excessively reducing the strength of the wire that has been enhanced by refinement of the crystal structure and work hardening.

For the softening treatment, continuous treatment or batch treatment may be used. As to the atmosphere during the softening treatment, in order to suppress generation of an oxide film on the surface of the wire due to heat during the treatment, the atmosphere is preferably air or an atmosphere with a lower oxygen content (such as non-oxidizing atmosphere for example). Examples of the non-oxidizing atmosphere may include vacuum atmosphere (reduced-pressure atmosphere), inert gas atmosphere such as nitrogen ($N_2$) or argon (Ar), and reducing gas atmosphere such as hydrogen-contained gas (hydrogen ($H_2$) only, gas mixture of an inert gas such as $N_2$, Ar or helium (He) and hydrogen ($H_2$), for example), and carbonic-acid-gas-contained gas (gas mixture of carbon monoxide (CO) and carbon dioxide ($CO_2$), for example).

<Batch Treatment>

The batch treatment refers to a treatment method of heating a workpiece to be heated that is enclosed in a heating vessel (atmosphere furnace, such as box-shaped furnace for example). While the throughput per treatment is limited, the treatment method can easily manage the heating state of the whole workpiece. The batch treatment can set the heating temperature to 250° C. or more to allow the elongation of the wire to be 10% or more. Preferred conditions are that the heating temperature is not less than 300° C. and not more than 500° C., and the holding time is not less than 0.5 hour and not more than 6 hours. Where the heating temperature is lower than 250° C., the toughness and the electrical conductivity are difficult to be improved. Where the heating temperature is higher than 500° C. or the holding time is longer than 6 hours, the strength decreases.

<Continuous Treatment>

The continuous treatment refers to a treatment method of continuously supplying a workpiece to be heated into a heating vessel and continuously heating the workpiece, and has advantages including: 1. the wire can be heated continuously and therefore workability is excellent; and 2. the wire can be heated uniformly in the longitudinal direction and therefore variation in characteristics in the longitudinal direction of the wire can be suppressed. In particular, in the case where a long wire such as the one used as a conductor for an electric wire undergoes the softening treatment, the continuous treatment can suitably be used. Examples of the continuous treatment may include a direct energizing heating method heating a workpiece to be heated by resistance heating (continuous softening treatment by means of electric power), an indirect energizing heating method heating a workpiece to be heated by electromagnetic induction of high frequencies (continuous softening treatment by high-frequency induction heating), and a furnace method feeding a workpiece to be heated into a heating vessel (pipe softening furnace) with a heating atmosphere and heating the workpiece by heat transfer. A wire with an elongation of 10% or more is obtained by the continuous treatment in the following manner for example. A sample is subjected to softening treatment in which a control parameter that may be responsible for a desired characteristic (elongation here) is varied as appropriate, the characteristic (elongation) of the sample at this time is measured, and correlation data between the value of the parameter and the measured data is prepared. Based on the correlation data, the parameter is adjusted so that a desired characteristic (elongation) may be obtained. The control parameter for the method by means of electric power may include the rate at which the workpiece is fed into the vessel (wire rate), the size of the workpiece to be heated (wire diameter), and the electric current value, for example. The control parameter for the furnace method may include the rate at which the workpiece is fed into the vessel (wire rate), the size of the workpiece to be heated (wire diameter), and the size of the furnace (diameter of the pipe softening furnace), for example. In the case where a softening apparatus is placed on the side of the wiredrawing machine from which a wiredrawn material is discharged, the wire rate may be set to several hundreds of m/min or more, for example, 400 m/min or more to thereby obtain a wire with an elongation of 10% or more.

<<Other Steps>>

The manufacturing method of the present invention may further include the step of forming a stranded wire by stranding together a plurality of the above-described wiredrawn materials or softened materials, and the step of forming a compressed wire with a predetermined wire diameter by compression-molding this stranded wire to thereby manufacture a compressed wire. In the case of the stranded wire form, the softening treatment may be performed only on the wiredrawn material before being stranded, or before and after the wires are stranded, or the softening treatment may not be performed on the drawn wire before being stranded and may be performed only on the stranded wire or compressed wire. In the case where a softened material having a predetermined elongation is produced before the material is stranded and a compressed wire is formed by using this softened material or a compressed wire is formed by using a stranded wire (softened material) having been stranded to have a certain elongation, the softening treatment may not be performed after compression. The above-described insulating cover layer can be formed on the resultant compressed wire to produce a covered electric wire. A terminal portion may be attached to an end of the resultant covered dielectric wire, and a plurality of covered electric wires with terminal portions may be bound together to produce a wire harness.

Effects of the Invention

The Al alloy wire of the present invention, the Al alloy stranded wire of the present invention, the covered electric wire of the present invention, and the Al alloy of the present invention have a high strength and a high toughness as well as a high electrical conductivity. Further, the wire harness of the present invention has well-balanced strength, toughness, and electrical conductivity and is lightweight. The manufacturing method of the present invention can produce the above-described Al alloy wire of the present invention with high productivity.

MODES FOR CARRYING OUT THE INVENTION

Figure 1:
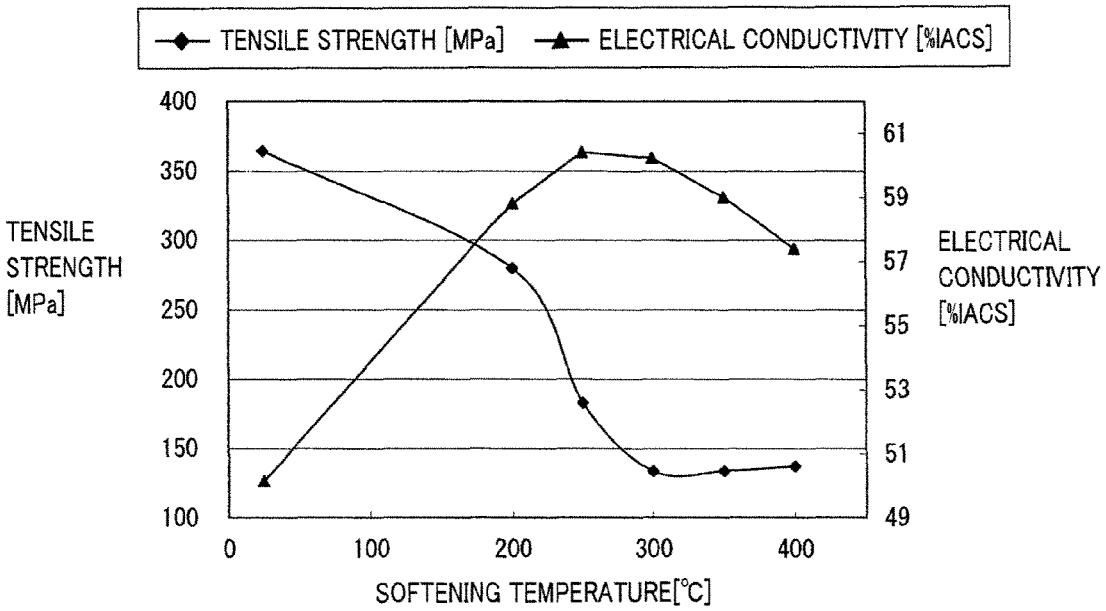
FIG. 1 is a graph showing a relationship of a temperature for softening treatment with an electrical conductivity and a tensile strength.

An Al alloy wire is produced, and this Al alloy wire is used to further produce a covered electric wire. Various characteristics of the Al alloy wire and the covered electric wire have been examined. The covered electric wire is produced through a procedure in the order of casting, rolling, wiredrawing, stranded wire, compression, softening, formation of an insulating cover layer.

[Characteristics of Al Alloy Wire]

First, an Al alloy wire is produced. As a base, pure aluminum (not less than 99.7% by mass of Al) is prepared and melt. To the obtained molten metal (molten aluminum), the additive elements shown in Table 1 with respective contents shown in Table 1 are added to produce a molten Al alloy. On the molten Al alloy with adjusted components, a hydrogen gas removal treatment and/or a foreign-matter removal treatment are/is preferably performed as appropriate.

A belt-wheel-type continuous casting and rolling machine is used to continuously perform casting and hot rolling on the prepared molten Al alloy to produce a wire rod of ϕ9.5 mm (continuously cast and rolled material). Alternatively, the above-described molten Al alloy is poured into a predetermined fixed mold and cooled to produce a billet cast material, on which a solution treatment and an aging treatment (180° C.×16 hours) are performed and thereafter hot rolling is performed to produce a wire rod of ϕ9.5 mm (rolled material). For samples containing Ti or containing Ti and B, Ti particle or $TiB_2$ wire is fed to the molten Al alloy immediately before being cast so that the content(s) as shown in Table 1 is (are) satisfied. As to Sample No. 1-5, the cast material is hot-rolled without being aging-treated.

The above-described wire rod is subjected to cold wiredrawing to produce a wiredrawn material with a wire diameter of ϕ0.3 mm or ϕ1 mm. The wiredrawn material thus obtained is subjected to a softening treatment (batch treatment by means of a box-shaped furnace) in the atmosphere and at the heating temperature shown in Table 1 to produce a softened material (Al alloy wire). The holding time of the softening treatment is 3 hours for each sample. For comparison's sake, an untreated material (Sample No. 1-102) that is not softening-treated after being wiredrawn has also been prepared.

For the obtained softened material with a wire diameter of ϕ0.3 mm and the untreated material, the tensile strength (MPa), the elongation (%), and the electrical conductivity (% IACS) have been measured. The results are shown in Table 2. Further, for the obtained softened material with a wire diameter of ϕ1 mm and the untreated material, the drop-off resistance of a terminal portion has been examined. The results are shown in Table 2.

The tensile strength (MPa) and the elongation (%, fracture elongation) have been measured in compliance with JIS Z 2241 (method of tensile test for metallic materials, 1998) by means of a general-purpose tensile tester. The electrical conductivity (% IACS) has been measured by the bridge method.

Figure 2:
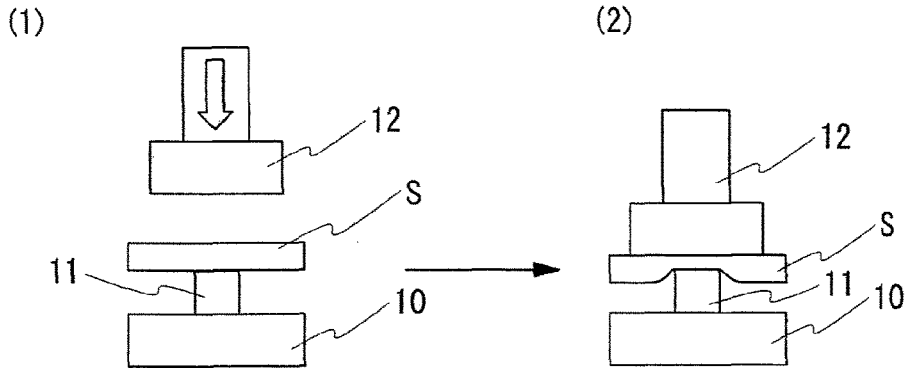
FIG. 2 is an illustration showing a test method for a compression test.

As to the drop-off resistance of a terminal portion, a compression test has been conducted to determine a residual load ratio (%), and the residual load ratio has been used to evaluate the drop-off resistance. FIG. 2 is an illustration for illustrating a test method for the compression test. On a support table 10 having a protrusion 11, a sample S is placed so that the two opposite ends of sample S project from protrusion 11 (FIG. 2 (1)). In this state, a press jig 12 is pressed against sample S to compress sample S (FIG. 2 (2)). Until the wire diameter of sample S located between protrusion 11 and press jig 12 becomes 50%, a load is applied by press jig 12 to sample S. When the wire diameter becomes 50%, the loaded state at this time is held for a predetermined period (14 to 16 hours) and the load applied to sample S in this holding period is measured. The residual load ratio (%) is defined as (load applied to sample S after a predetermined time has elapsed/load applied to sample S at the time when the wire diameter becomes 50%)×100. A wire with a higher residual load ratio is less likely to be relaxed in terms of the stress applied to the wire, and the state in which this wire and press jig 12 are pressed against each other is more easy to maintain. Therefore, supposing that the press jig is replaced with a terminal portion, the terminal portion is less likely to drop off from the wire as the residual load ratio is higher.

TABLE 1

| Softened Material Sample | Additive Elements (mass %) | | | | | | Conditions of Manufacture | | | |
|---|---|---|---|---|---|---|---|---|---|---|
| | | | | | | | Casting | Aging | Softening Temperature | Softening Treatment |
| No. | Mg | Si | Cu | Ti | B | Mg/Si | Method | Treatment | (° C.) | Atmosphere |
| 1-1 | 0.48 | 0.19 | 0.2 | — | — | 2.5 | continuous casting | 180° C. × 16 H | 350 | argon gas |
| 1-2 | 0.33 | 0.34 | 0.3 | 0.02 | — | 1.0 | continuous casting | 180° C. × 16 H | 350 | reducing gas |
| 1-3 | 0.55 | 0.32 | 0.2 | 0.02 | 0.005 | 1.7 | continuous casting | 180° C. × 16 H | 350 | nitrogen gas |
| 1-4 | 0.55 | 0.47 | 0.2 | 0.02 | 0.005 | 1.2 | continuous casting | 180° C. × 16 H | 350 | reducing gas |
| 1-5 | 0.55 | 0.47 | 0.2 | 0.02 | 0.005 | 1.2 | continuous casting | none | 350 | reducing gas |
| 1-6 | 0.55 | 0.47 | 0.2 | 0.02 | 0.005 | 1.2 | billet casting | 180° C. × 16 H | 350 | reducing gas |
| 1-100 | 1.5 | 1.1 | 0.6 | 0.02 | 0.005 | 1.4 | continuous casting | 180° C. × 16 H | 350 | reducing gas |
| 1-101 | 0.1 | 0.01 | 0.05 | 0.02 | 0.005 | 10.0 | continuous casting | 180° C. × 16 H | 350 | reducing gas |
| 1-102 | 0.55 | 0.47 | 0.2 | 0.02 | 0.005 | 1.2 | continuous casting | 180° C. × 16 H | — | — |

TABLE 2

| Softened Material Sample No. | Material Characteristics: Tensile Strength (MPa) | Elongation (%) | Conductivity (% IACS) | Residual Load Ratio (%) |
|---|---|---|---|---|
| 1-1 | 124 | 19 | 58 | 91 |
| 1-2 | 130 | 20 | 59 | 93 |
| 1-3 | 130 | 18 | 59 | 93 |
| 1-4 | 134 | 18 | 59 | 95 |
| 1-5 | 128 | 20 | 59 | 95 |
| 1-6 | 134 | 15 | 59 | 95 |
| 1-100 | 320 | 9 | 43 | 98 |
| 1-101 | 81 | 28 | 61 | 82 |
| 1-102 | 364 | 1 | 50 | 95 |

As shown in Table 1, Samples No. 1-1 to No. 1-6 each made of an Al—Mg—Si—Cu-based alloy having a specific composition and having undergone the softening treatment have an electrical conductivity of not less than 58% IACS, an elongation of not less than 10%, and further have a tensile strength of not less than 120 MPa. Namely, Samples No. 1-1 to No. 1-6 each have not only a high electrical conductivity and a high toughness but also a high strength. Moreover, Samples No. 1-1 to No. 1-6 having a residual load ratio of not less than 90% are excellent in drop-off resistance of a terminal portion. From a comparison between Sample No. 1-4 and Sample No. 1-5 of the same composition, it is seen that sample No. 1-4 having been aging-treated has a higher strength. In addition, from a comparison between samples of the same composition, it is seen that a sample on which continuous casting and rolling has been performed tends to have a larger elongation than a sample on which billet casting has been performed.

In contrast, Sample No. 1-102 which has not been softening-treated has a high strength while its elongation is very smaller resulting in lower toughness and its electrical conductivity is lower. As to a sample which has been softening-treated while it does not have a specific composition, specifically Sample No. 1-100 with higher contents of additive elements has a high strength while its elongation and electrical conductivity are lower, and sample No. 1-101 with lower contents of additive elements has a large elongation and a high electrical conductivity while its strength is lower.

[Softening Treatment Condition and Characteristics]

Samples softening-treated under different conditions have been produced and the electrical conductivity (%) and the tensile strength (MPa) of the resultant samples have been examined. The results are shown in FIG. 1. Here, the softening treatment has been performed on a wiredrawn material with the composition of Sample No. 1-4 and a wire diameter of ϕ0.3 mm. The softening treatment has been performed on the wiredrawn material as a batch treatment using a box-shaped furnace (reducing gas atmosphere) at a heating temperature (softening temperature) selected as appropriate from a range of 200 to 400° C. (holding time: 3 hours).

As seen from FIG. 1, the softening treatment can be performed at a heating temperature of 250° C. or more to obtain a softened material having an electrical conductivity of not less than 58% IACS and a tensile strength of not less than 120 MPa. The temperature of 200° C. appears to cause the tensile strength to be too high, resulting in a smaller elongation and a lower toughness.

[Characteristics of Covered Electric Wire]

It is expected that an Al alloy wire made of an Al—Mg—Si—Cu-based alloy having a specific composition and softening-treated as described above can suitably be used as a conductor for an electric wire of a wire harness. Thus, a covered electric wire has been produced to examine its mechanical characteristics.

A plurality of wiredrawn materials (see Table 1 for the composition) with a wire diameter of ϕ0.3 mm produced in the above-described manner are stranded together to produce a stranded wire. Here, 11 drawn wires in total consisting of three inner wires and eight outer wires are stranded together and thereafter subjected to compression working so that the profile of the cross section is circular so as to produce a compressed wire of 0.75 $mm^2$. On the resultant compressed wire, a softening treatment (batch treatment by means of a box-shaped furnace, holding time: 3 hours) is performed in the atmosphere and at the heating temperature shown in Table 1. On the outer periphery of the softened material thus obtained, an insulating material (here halogen-free insulating material) is used to form an insulating cover layer (0.2 mm in thickness) so as to produce a covered electric wire. For comparison's sake, an untreated material (Sample No. 2-102) has also been prepared by stranding wiredrawn materials together and compressing the stranded wire into a compressed wire on which no softening treatment is performed. Further, for comparison's sake, a compressed wire has been produced by stranding together 16 wiredrawn materials having the composition of Sample No. 1-101 and a wire diameter of ϕ0.3 mm, thereafter performing compression molding in a similar manner to produce a compressed wire of 1.25 $mm^2$, and performing the softening treatment and formation of an insulating cover layer in a similar manner to produce a covered electric wire (Sample No. 2-103).

For the covered electric wires thus obtained, the impact resistance (J/m), the terminal securing strength (N), and the terminal securing strength (N) after an endurance test have been examined. The results are shown in Table 3.

Figure 3:
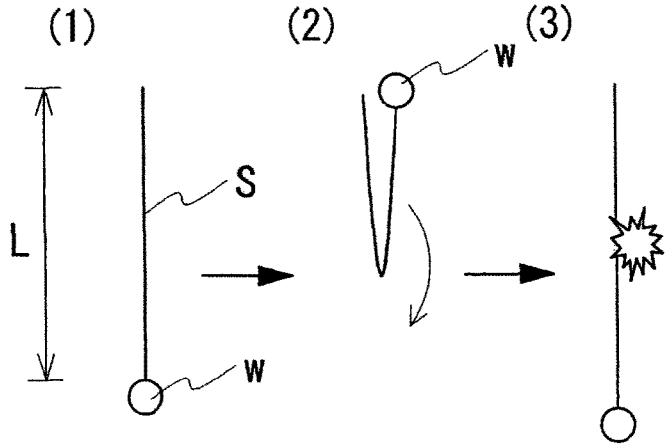
FIG. 3 is an illustration for illustrating a test method for an impact resistance test.

The impact resistance (J/m or (N·m)/m) has been evaluated in the following manner. FIG. 3 is an illustration for illustrating a test method for an impact resistance test. To an end of a sample S (point-to-point distance to be evaluated L: 1 m), a weight w is attached (FIG. 3 (1)), this weight w is raised by 1 m and thereafter let fall freely (FIG. 3 (2)). Then, a maximum weight (kg) of weight w that does not cause breakage of sample S is measured, the measured weight is multiplied by the gravitational acceleration (9.8 $m/s^2$) and the fall distance 1 m, the product is divided by the fall distance, and the resultant value thus determined is used as an impact resistance (J/m or (N·m)/m) for evaluation.

Figure 4:
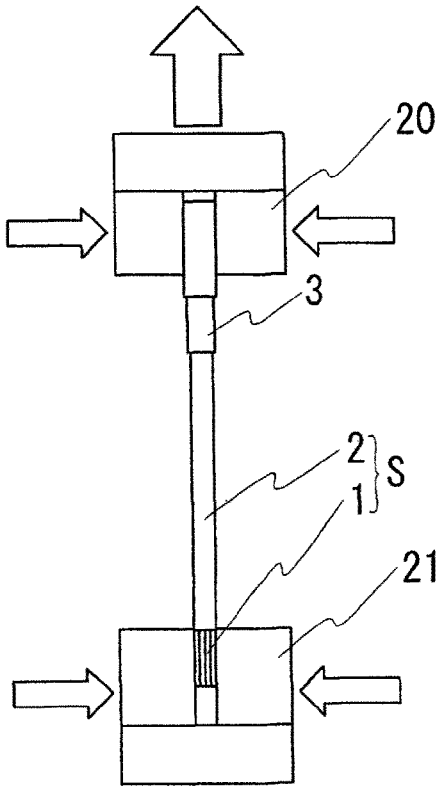
FIG. 4 is an illustration for illustrating a test method for a terminal-securing-strength test.

The terminal securing strength (N) has been evaluated in the following manner. FIG. 4 is an illustration for illustrating a test method for a terminal securing strength test. For a sample S formed of a stranded wire 1 around which an insulating cover layer 2 is provided, cover layer 2 is stripped at the two opposite ends to expose stranded wire 1. A terminal portion 3 is attached to one end of stranded wire 1 and this terminal portion 3 is held in a terminal chuck 20. The other end of stranded wire 1 is held in a wire chuck 21. A general-purpose tensile tester is used to measure the maximum load (N) at the time of fracture of sample S held at its two ends by chucks 20, 21, and the maximum load (N) is used as a terminal securing strength (N) for evaluation.

As to the terminal securing strength (N) after the endurance test, sample S with its two ends held in chucks 20, 21 is placed in a high-temperature environment (120° C.×120 hours) and thereafter the tensile tester is used as described above to measure the maximum load (N) at the time of fracture and evaluate the maximum load (N).

TABLE 3

| Electric Wire Sample No. | Softened Material Sample No. | Impact Resistance (J/m) | Terminal Securing Strength (N) | Terminal Securing Strength after Endurance Test (N) |
|---|---|---|---|---|
| | | 0.75 $mm^2$ Electric Wire Performance | | |
| 2-1 | 1-1 | 11 | 72 | 71 |
| 2-2 | 1-2 | 11 | 74 | 73 |
| 2-3 | 1-3 | 11 | 74 | 73 |
| 2-4 | 1-4 | 11 | 75 | 74 |
| 2-5 | 1-5 | 11 | 73 | 73 |
| 2-6 | 1-6 | 10 | 75 | 74 |
| 2-100 | 1-100 | 7 | 157 | 154 |
| 2-101 | 1-101 | 12 | 55 | 49 |
| 2-102 | 1-102 | 1 | 180 | 178 |
| | | 1.25 $mm^2$ Electric Wire Performance | | |
| 2-103 | 1-101 | 13 | 72 | 63 |

As shown in Table 3, it is seen that the covered electric wires of Samples No. 2-1 to No. 2-6 for which a stranded wire made of an Al—Mg—Si—Cu-based alloy with a specific composition and having undergone the softening treatment is used have an excellent impact resistance and a high connection strength between the wire and a terminal portion. It is also seen that Samples No. 2-1 to No. 2-6 have a small degree of decrease in connection strength with the terminal portion even when exposed to a high-temperature environment, and are also excellent in heat resistance. Further, it is seen that Samples No. 2-1 to No. 2-6 each have an impact resistance and a terminal securing strength that are substantially equal to or larger than those of Sample No. 2-103 with a larger cross-sectional area.

As described above, a covered electric wire for which an Al alloy wire made of an Al—Mg—Si—Cu-based alloy with a specific composition and having been softening-treated is used has a high electrical conductivity, a high toughness, and a high strength as well as an excellent connection strength with a terminal portion and an excellent impact resistance as well. Therefore, it is expected that this covered electric wire can be used suitably for a wire harness, particularly for a wire harness for a motor vehicle.

It should be noted that the above-described embodiment may be modified as appropriate without going beyond the scope of the present invention, and is not limited to the above-described structure. For example, the content of Mg, Si, Cu each may be varied within a specific range. Further, the softening treatment may be performed in the form of continuous treatment. Moreover, the number of wires to form a stranded wire may be changed.

INDUSTRIAL APPLICABILITY

The wire harness of the present invention can suitably be used for applications where lightweight as well as high strength, high toughness, and high electrical conductivity are desired, specifically for a wiring of a motor vehicle, for example. The covered electric wire of the present invention, the aluminum alloy wire of the present invention, or the aluminum stranded wire of the present invention can suitably be used as an electric wire of this wire harness or a conductor for the electric wire. Further, the method of manufacturing an aluminum alloy wire of the present invention can suitably be used for manufacture of the above-described aluminum alloy wire of the present invention.

DESCRIPTION OF THE REFERENCE SIGNS

1 stranded wire; 2 insulating cover layer; 3 terminal portion; S sample; w weight; 10 support table; 11 protrusion; 12 press jig; 20 terminal chuck; 21 wire chuck

The invention claimed is:

1. An aluminum alloy wire used as a conductor, said aluminum alloy wire comprising not less than 0.2% and not more than 1.0% by mass of Mg, not less than 0.1% and not more than 1.0% by mass of Si, not less than 0.1% and not more than 0.5% by mass of Cu, and a remainder consisting of Al and an impurity, a mass ratio Mg/Si of said Mg to said Si satisfying $0.8 \leq Mg/Si \leq 2.7$, said aluminum alloy wire having an electrical conductivity of not less than 58% IACS, said aluminum alloy wire having an elongation of not less than 10%, and said aluminum alloy wire has a tensile strength of not less than 120 MPa and not more than 200 MPa.

2. The aluminum alloy wire according to claim 1, further comprising at least one of Ti and B, wherein a content by mass ratio of Ti is not less than 100 ppm and not more than 500 ppm, and a content by mass ratio of B is not less than 10 ppm and not more than 50 ppm.

3. The aluminum alloy wire according to claim 1, wherein said aluminum alloy wire has a wire diameter of not less than 0.2 mm and not more than 1.5 mm.

4. An aluminum alloy stranded wire formed by stranding together a plurality of aluminum alloy wires as recited in claim 1.

5. A covered electric wire comprising as a conductor one of an aluminum alloy wire as recited in claim 1, an aluminum alloy stranded wire formed by stranding together a plurality of said aluminum alloy wires, and a compressed wire formed by compression-molding said stranded wire, and comprising an insulating cover layer on an outer periphery of the conductor.

6. A wire harness comprising a covered electric wire as recited in claim 5, and a terminal portion attached to an end of the electric wire.

7. The wire harness according to claim 6, wherein said wire harness is used for a motor vehicle.

8. A method of manufacturing an aluminum alloy wire used as a conductor, comprising the steps of:

forming a cast material by casting a molten aluminum alloy containing not less than 0.2% and not more than 1.0% by mass of Mg, not less than 0.1% and not more than 1.0% by mass of Si, not less than 0.1% and not more than 0.5% by mass of Cu where a mass ratio Mg/Si of said Mg to said Si satisfying $0.8 \leq Mg/Si \leq 2.7$, and a remainder consisting of Al;

forming a rolled material by performing rolling on said cast material;

forming a wiredrawn material by performing wiredrawing on said rolled material; and forming a softened material by performing softening treatment on said wiredrawn material, said softening treatment being performed on said wiredrawn material so that the wiredrawn material having undergone the softening treatment has an elongation of not less than 10%, and said aluminum alloy wire has a tensile strength of not less than 120 MPa and not more than 200 MPa.

9. The method of manufacturing an aluminum alloy wire according to claim 8, wherein said softening treatment is continuous softening treatment by means of energization or continuous softening treatment by high-frequency induction heating and is performed in a non-oxidizing atmosphere.

10. The method of manufacturing an aluminum alloy wire according to claim 8, wherein said softening treatment is a batch treatment using an atmosphere furnace and is performed in a non-oxidizing atmosphere and at an atmosphere temperature of not less than 250° C.

11. The method of manufacturing an aluminum alloy wire according to claim 8, wherein said steps of casting and rolling are performed continuously to form a continuously cast and rolled material.

12. The method of manufacturing an aluminum alloy wire according to claim 8, wherein aging treatment is performed at a heating temperature of not less than 100° C. on at least one of said cast material after casting and before rolling, said rolled material after rolling and before wiredrawing, and the wiredrawn material during wiredrawing.

13. The method of manufacturing an aluminum alloy wire according to claim 8, comprising the steps of:

forming a stranded wire by stranding together a plurality of said wiredrawn materials or softened materials; and forming a compressed wire of a predetermined wire diameter by compressing said stranded wire, wherein said softening treatment is performed on said compressed wire.

14. An aluminum alloy comprising not less than 0.2% and not more than 1.0% by mass of Mg, not less than 0.1% and not more than 1.0% by mass of Si not less than 0.1% and not more than 0.5% by mass of Cu, and a remainder consisting of Al and an impurity, a mass ratio Mg/Si of said Mg to said Si satisfying $0.8 \leq Mg/Si \leq 2.7$, said aluminum alloy having an electrical conductivity of not less than 58% IACS, said aluminum alloy having an elongation of not less than 10%, and said aluminum alloy wire has a tensile strength of not less than 120 MPa and not more than 200 MPa.

* * * * *